US006707258B2

(12) United States Patent
Lee

(10) Patent No.: US 6,707,258 B2
(45) Date of Patent: Mar. 16, 2004

(54) PLASMA DISPLAY PANEL DRIVING METHOD AND APPARATUS

(75) Inventor: Joo-Yul Lee, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/418,919

(22) Filed: Apr. 17, 2003

(65) Prior Publication Data

US 2003/0214241 A1 Nov. 20, 2003

(30) Foreign Application Priority Data

May 14, 2002 (KR) ..... 10-2002-26449

(51) Int. Cl.[7] ..... G09G 3/28

(52) U.S. Cl. ..... 315/169.3; 315/169.4; 345/66; 345/76

(58) Field of Search ..... 315/169.3, 169.4; 345/60, 66, 76

(56) References Cited

U.S. PATENT DOCUMENTS 4,866,349 A 9/1989 Weber et al.
5,081,400 A 1/1992 Weber et al.
6,111,556 A * 8/2000 Moon ..... 345/60
6,628,087 B2 * 9/2003 Roh et al. ..... 315/169.3

FOREIGN PATENT DOCUMENTS

JP 8-152865 6/1996

OTHER PUBLICATIONS

Patent Abstract of Japan, Publication No. 08–152865, Published on Jun. 11, 1996, in the name of Oba Masatake, et al.

* cited by examiner

*Primary Examiner*—David Vu
(74) *Attorney, Agent, or Firm*—Christie, Parker & Hale, LLP

(57) ABSTRACT

A PDP driving and power recovery method. X and Y electrode voltages of a panel capacitor are maintained to be V2 and V1 volts, respectively. The Y electrode voltage is converted into V2 to store energy in the inductor, the energy stored therein is used to convert the X electrode voltage into V1, and the voltages at the X and the Y electrodes are maintained to be V1 and V2, respectively. The voltage at the X electrode is converted into V2 to store energy in the inductor, and the energy stored therein is used to convert the voltage at the Y electrode into V1.

25 Claims, 12 Drawing Sheets

PLASMA DISPLAY PANEL DRIVING METHOD AND APPARATUS

CROSS REFERENCE TO RELATED APPLICATION

This application claims priority to and the benefit of Korean Patent Application No. 2002-26449 filed on May 14, 2002 in the Korean Intellectual Property Office, the content of which is incorporated herein by reference.

BACKGROUND OF THE INVENTION (a) Field of the Invention

The present invention relates to a plasma display panel (PDP) driving device and method. More specifically, the present invention relates to a sustain and discharge circuit of a PDP.

(b) Description of the Related Art

In general, a PDP is a flat plate display for displaying characters or images using plasma generated by gas discharge. Pixels ranging from hundreds of thousands to more than millions are arranged in a matrix form according to the size of the PDP. PDPs are categorized as direct current (DC) PDPs and alternating current (AC) PDPs according to patterns of the waveforms of applied driving voltages and structures of discharge cells.

Current directly flows in discharge spaces while a voltage is supplied to the DC PDP, because electrodes of the DC PDP are exposed to the discharge spaces. Therefore, a resistor for restricting the current must be provided to the DC PDP. On the other hand, in the case of the AC PDP, the current is restricted due to the natural formation of a capacitance component because a dielectric layer covers the electrodes. The AC PDP has a longer life than the DC PDP, since the electrodes are protected against shock caused by ions during discharge.

In general, a method for driving the AC PDP includes a reset period, an addressing period, a sustain period, and an erase period.

In the reset period, the states of the respective cells are reset in order to smoothly address the cells. In the addressing period, the cells that are turned on and the cells that are not turned on in a panel are selected, and wall charges are accumulated to the cells that are turned on (i.e., the addressed cells). In the sustain period, discharge is performed in order to actually display pictures on the addressed cells. In the erase period, the wall charges of the cells are reduced to thereby terminate sustain-discharge.

In the AC PDP, since a sustain electrode and a scan electrode for sustain and discharge of the PDP operate as a capacitive load, a capacitor is provided between the scan electrode and the sustain electrode, and it will be equivalently referred to as a panel capacitor hereinafter. Therefore, reactive power is required in addition to the discharging power in order to apply waveforms for the sustain-discharge to the scan and sustain electrodes. A circuit for recovering and re-using the reactive power is referred to as a power recovery circuit. L. F. Weber discloses the power recovery circuits in U.S. Pat. Nos. 4,866,349 and 5,081,400, and Ooba also discloses them in Japanese Patent no. 2,755,201.

However, the sustain and discharge circuit proposed by the Weber patent requires an external capacitor used for a power recovery capacitor, the electric potential of which is to maintain half Vs. To achieve this, the capacity of the power recovery capacitor must be much greater than that of the panel capacitor.

Also, since the circuit proposed by Ooba has a voltage rising period of an X (or Y) electrode of the panel capacitor that is matched with a voltage falling period of the Y (or X) electrode, it cannot be applied to a PDP that requires different rising and falling periods.

SUMMARY OF THE INVENTION

In accordance with the present invention a power recovery PDP is provided. In one aspect of the present invention, a device for driving a PDP is provided, the PDP having a plurality of scan electrodes and sustain electrodes alternately arranged in pairs, wherein a panel capacitor is formed between the scan electrode and the sustain electrode. A first sustain and discharge unit is coupled to a first electrode of the panel capacitor, and coupled between a first power source for supplying a first voltage and a second power source for supplying a second voltage, for operating so that the first electrode may be maintained to be one of the first and the second voltages. A second sustain and discharge unit is coupled to a second electrode of the panel capacitor, and coupled between the first power source and the second power source so that the second electrode may be maintained to be one of the first and the second voltages. A charge and discharge unit, including at least one inductor coupled to the panel capacitor, is provided for converting a voltage at the second electrode into the second voltage to store energy in the inductor, using the energy stored in the inductor to convert the voltage at the first electrode into the first voltage, converting the voltage at the first electrode into the second voltage to store energy in the inductor, and using the energy stored in the inductor to convert the voltage at the second electrode into the first voltage.

The charge and discharge unit converts the voltages at the second and the first electrodes into the second and the first voltages, maintains the voltages at the first and the second electrodes to be the first and the second voltages, respectively, converts the voltages at the first and the second electrodes into the second and the first voltages, and maintains the voltages at the first and the second electrodes to be the second and the first voltages, respectively.

In another aspect of the present invention, a method for driving a PDP is provided, the PDP having a panel capacitor formed between a plurality of scan electrodes and a plurality of sustain electrodes alternately arranged with the scan electrodes, at least one inductor coupled to the panel capacitor, and a driver coupled between a first power source for supplying a first voltage and a second power source for supplying a second voltage. (a) The panel capacitor's voltages are maintained at a first electrode and a second electrode to be the second voltage and the first voltage, respectively. (b) The voltage at the second electrode is converted into the second voltage and storing energy in the inductor. (c) The energy stored in the inductor is used to convert the voltage at the first electrode into the first voltage; (d) maintaining the voltages at the first and the second electrodes to be the first and the second voltages, respectively. (e) The voltage at the first electrode is converted into the second voltage and storing energy in the inductor. (f) The energy stored in the inductor is used to convert the voltage at the second electrode into the first voltage.

In still another aspect of the present invention, a method for driving a PDP is provided, the PDP having a panel capacitor formed between a plurality of first and second electrodes alternately arranged in pairs, a first switch and a second switch coupled in series between a first power source for supplying a first voltage and a second power source for supplying a second voltage, wherein a point where the first and the second switches meet is coupled to the first electrode of the panel capacitor, a third switch and a fourth switch coupled in series between the first power source and the second power source, wherein a point where the third and the fourth switches meet is coupled to the second electrode of the panel capacitor, at least one inductor having one end coupled to the point where the first and the second switches meet, and a fifth switch and a sixth switch respectively coupled to the inductor, wherein a point where the fifth and sixth switches meet is coupled to the point where the third and fourth switches meet. (a) The second and the third switches are turned on to maintain voltages at the first and the second electrodes to be the second and the first voltages. (b) The third switch is turned off and the sixth switch is turned on to convert the voltage at the second electrode into the second voltage. (c) The second switch is turned off and the fourth switch is turned on to convert the voltage at the first electrode into the first voltage and maintain the voltage at the second electrode to be the second voltage. (d) The sixth switch is turned off and the first switch is turned on to maintain the voltages at the first and the second electrodes to be the first and the second voltages. (e) The first switch is turned off and the fifth switch is turned on to convert the voltage at the first electrode into the second voltage. (f) The fourth switch is turned off and the second switch is turned on to convert the voltage at the second electrode into the first voltage.

DETAILED DESCRIPTION

A PDP driving device and method according to certain embodiments of the present invention will be described with reference to drawings. Only certain embodiments of the invention have been shown and described. As will be realized, the invention is capable of modification without departing from the invention. Accordingly, the drawings and description are to be regarded as illustrative in nature and the invention is not merely limited to the embodiments disclosed.

Figure 1:
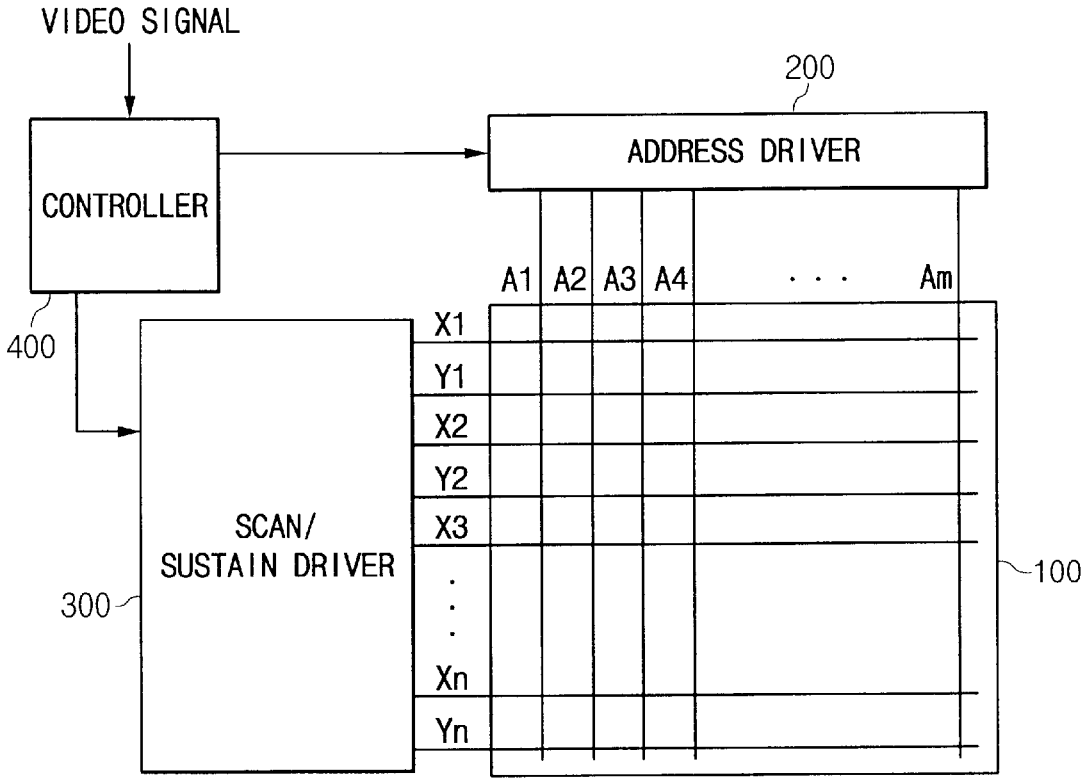
FIG. 1 shows a PDP according to an embodiment of the present invention.

FIG. 1 shows a PDP according to an embodiment of the present invention. As shown, the PDP includes plasma panel 100, address driver 200, scan/sustain driver 300, and controller 400.

Plasma panel 100 includes a plurality of address electrodes A1 through Am arranged in the column direction, a plurality of scan electrodes Y1 through Yn (referred to as Y electrodes hereinafter) arranged in the row direction, and a plurality of sustain electrodes X1 through Xn (referred to as X electrodes hereinafter) alternately arranged with the Y electrodes in the row direction. The X electrodes X1 through Xn are generated to be matched with respective Y electrodes Y1 through Yn, and their one ends are commonly coupled. Controller 400 receives external video signals, generates an address driving control signal and a sustain and discharge signal, and respectively supplies the signals to address driver 200 and scan and sustain driver 300.

Address driver 200 receives the address driving control signal from controller 400, and supplies display data signals for selecting discharging cells to be displayed to the respective address electrodes. Scan and sustain driver 300 receives the sustain and discharge signal from controller 400, and alternately inputs sustain and discharge pulses to the Y electrodes and the X electrodes. The sustain and discharge process is generated in the discharge cell selected according to the input sustain and discharge pulses.

Figure 2:
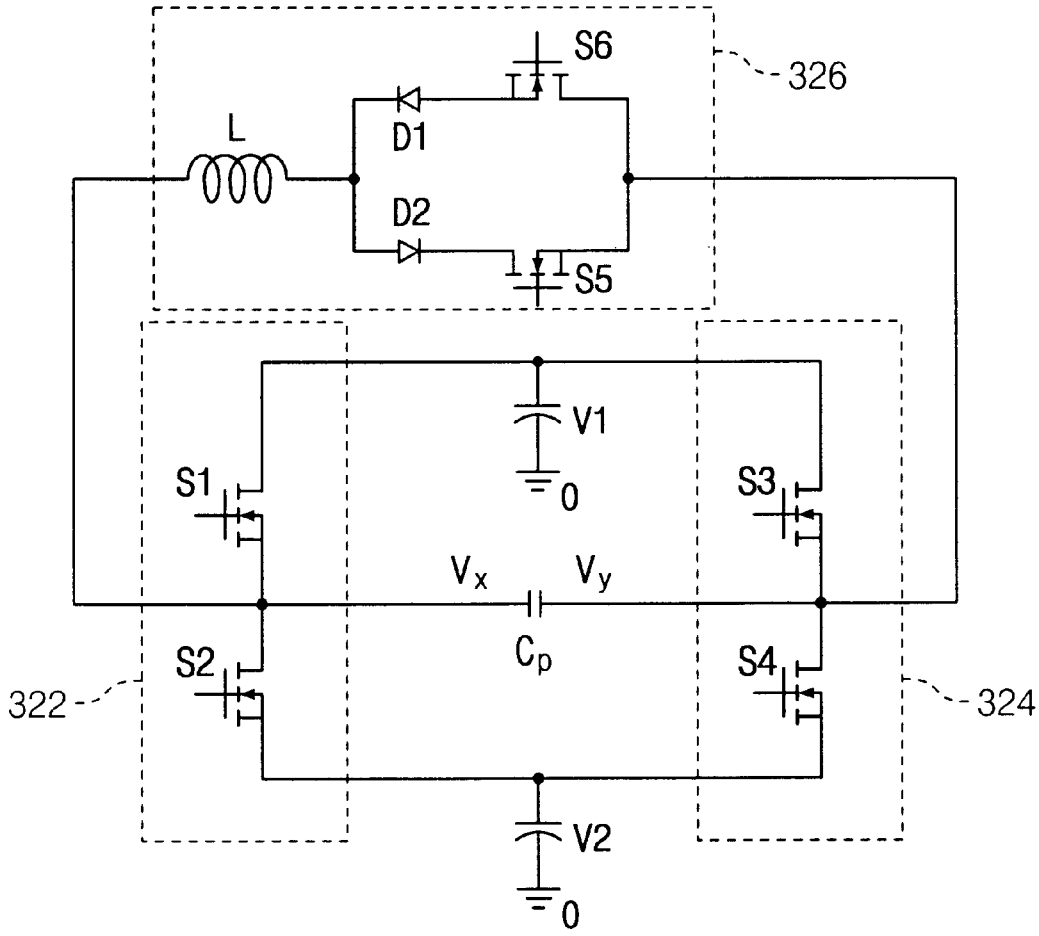
FIG. 2 shows a sustain and discharge circuit according to a first embodiment of the present invention.
Figure 3A:
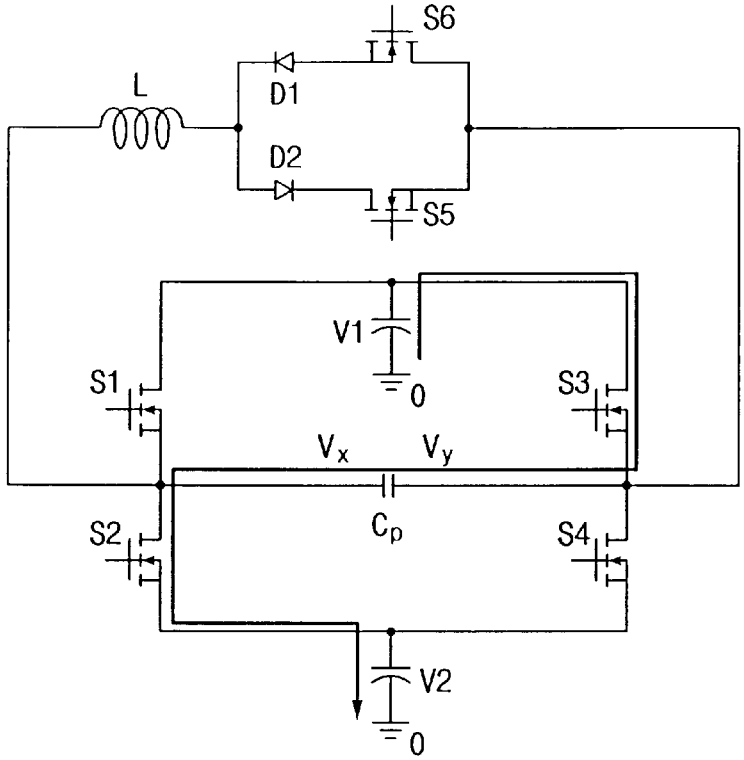
FIGS. 3A through 3F show current paths of respective modes according to the first embodiment of the present invention.
Figure 3B:
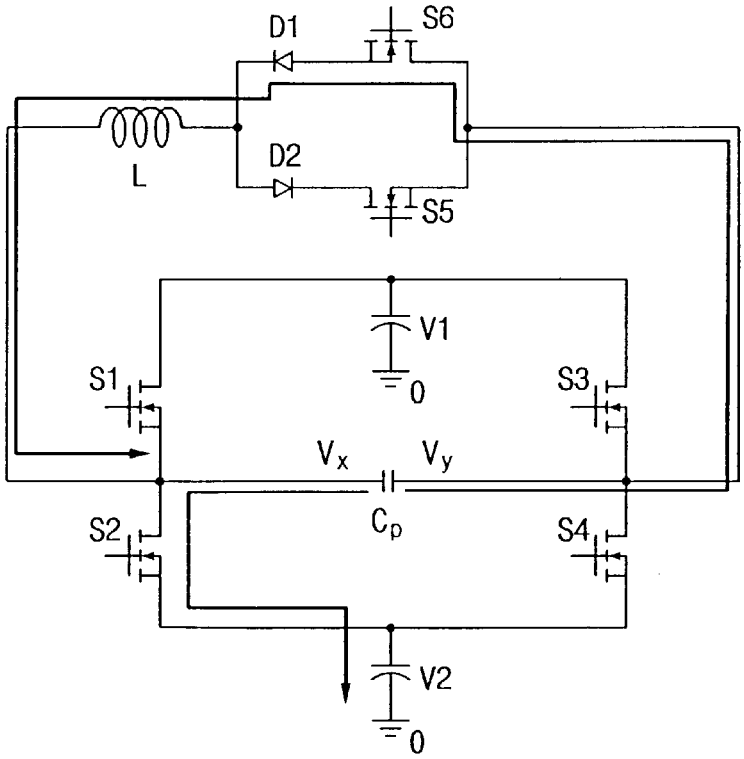
Figure 3C:
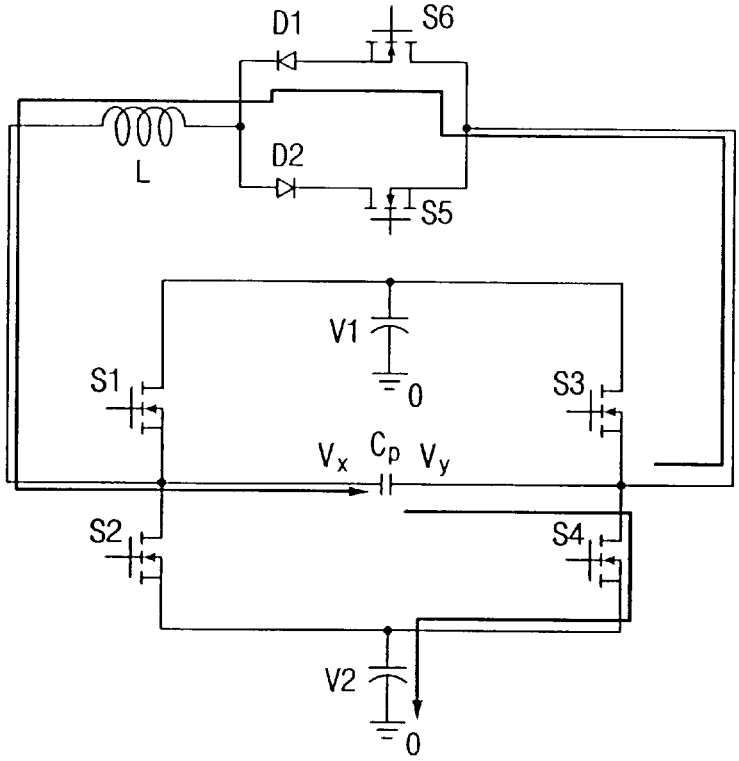
Figure 3D:
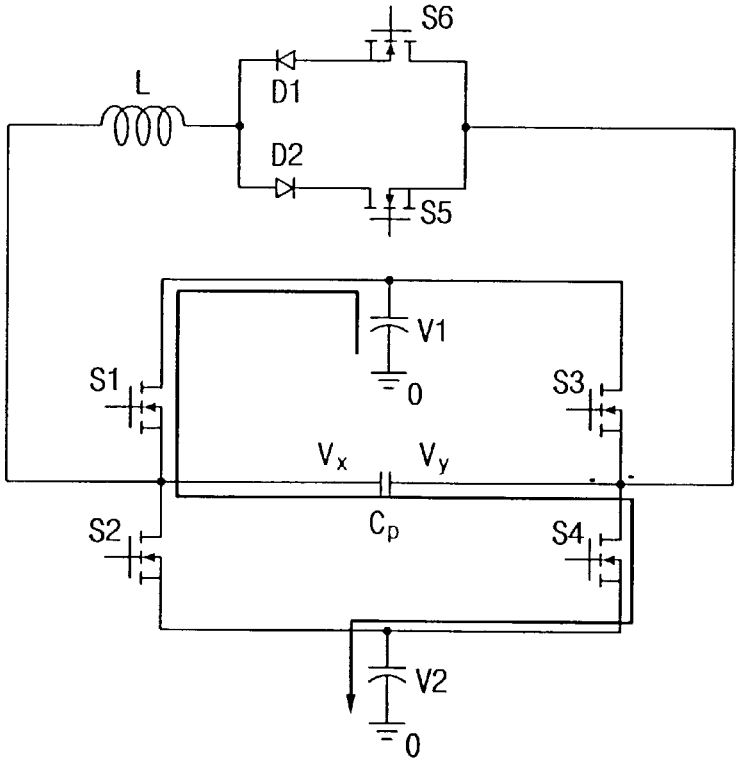
Figure 3E:
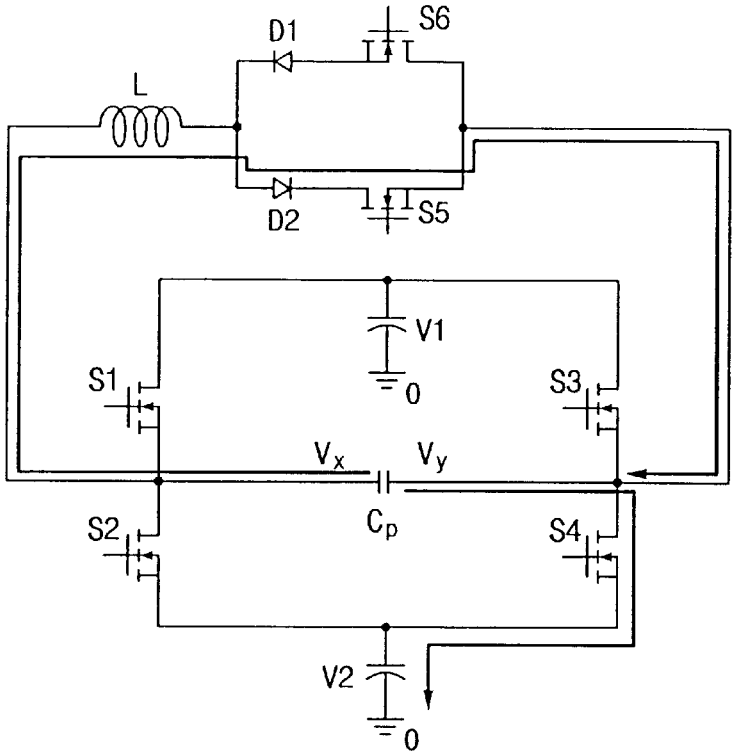
Figure 3F:
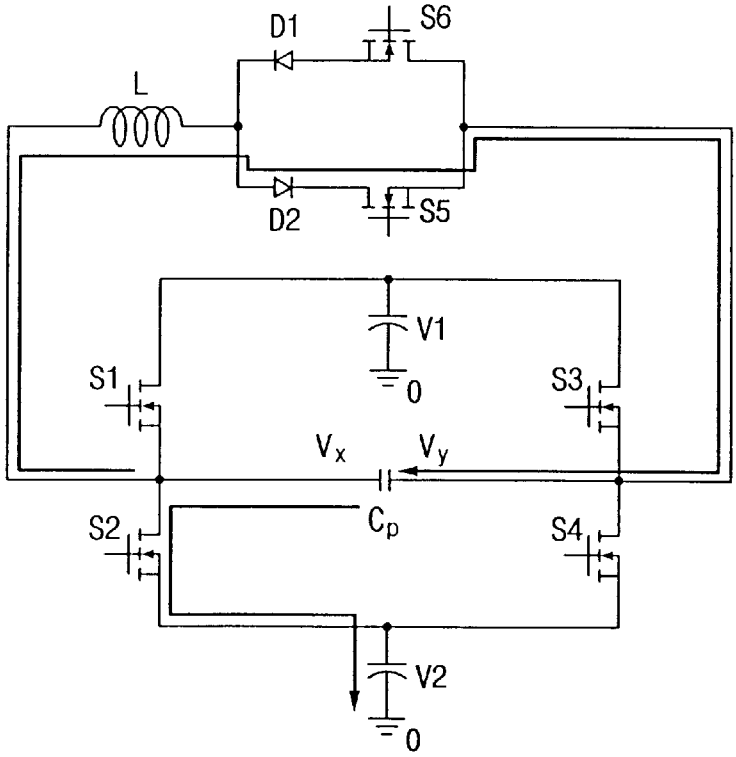
Figure 4:
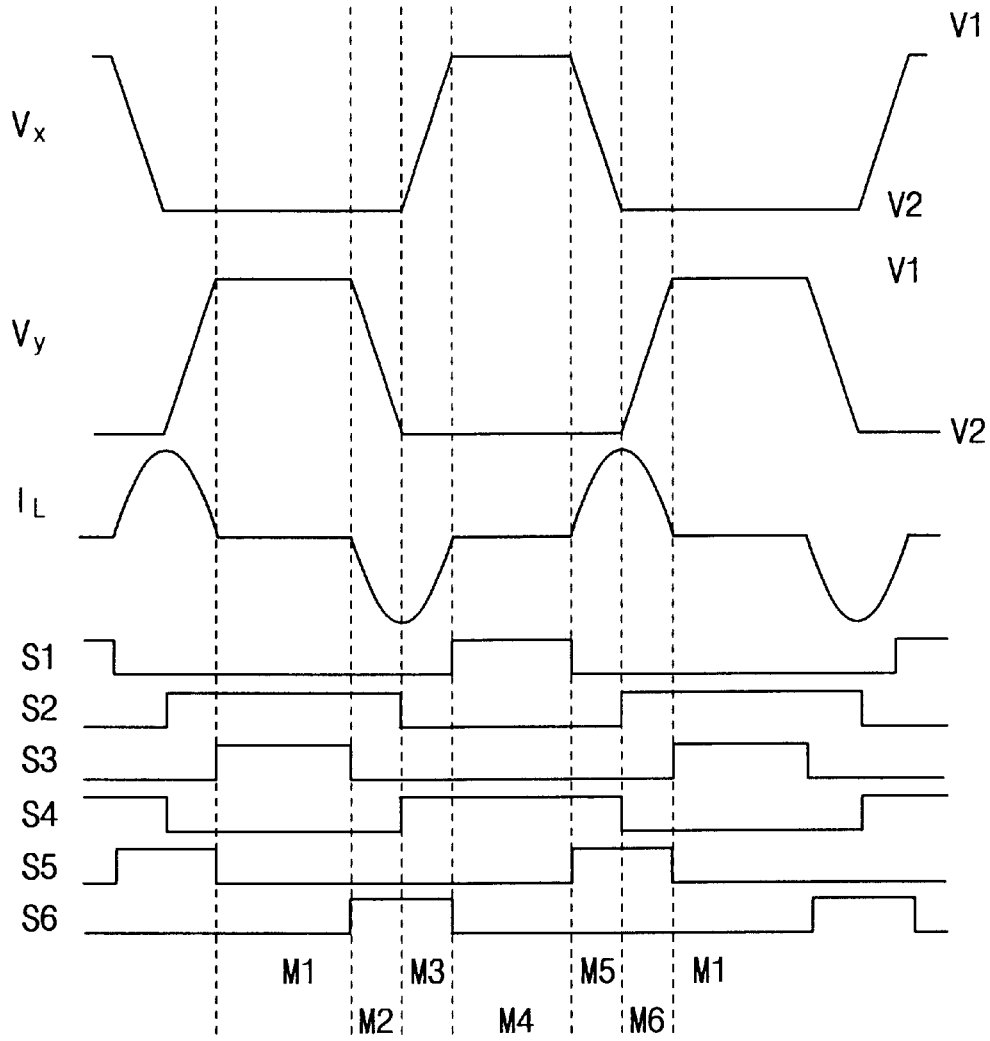
FIG. 4 shows an operational timing diagram of the PDP according to the first embodiment of the present invention.

Referring to FIGS. 2 through 4, a sustain and discharge circuit of scan and sustain driver 300 according to the first embodiment of the present invention will now be described. FIG. 2 shows a sustain and discharge circuit according to a first embodiment of the present invention. FIGS. 3(*a*) through 3(*f*) show current paths of respective modes according to the first embodiment of the present invention. FIG. 4 shows an operational timing diagram of the PDP according to the first embodiment of the present invention.

As shown in FIG. 2, the sustain and discharge circuit includes first and second sustain and discharge units 322 and 324, and charge and discharge unit 326. First and second sustain and discharge units 322 and 324 include switches S1 through S4, and charge and discharge unit 326 includes switches S5 and S6 and an inductor L.

Switches S1 and S2 are coupled in series between first power source V1 and a second power source V2, a point where switches S1 and S2 meet is coupled to the X electrode of panel capacitor Cp, switches S3 and S4 are coupled in series between first and second power sources V1 and V2, and a point where switches S3 and S4 meet is coupled to the Y electrode of panel capacitor Cp.

Switches S5 and S6 are coupled in parallel to one end of inductor L, and a point where switches S5 and S6 meet is coupled to the point where switches S3 and S4 meet.

Referring to FIG. 2, switches S1 through S6 are denoted as MOSFETs, and without being restricted to them, any other types of switches may be used. The switches may have body diodes of a pn junction separation configuration of a semiconductor IC.

Also, the sustain and discharge circuit may further include diodes D1 and D2 between inductor L and switches S6 and S5, and in this instance, diodes D1 and D2 break the current that may flow because of the body diodes of switches S6 and S5.

Referring to FIGS. 3A through 3F and 4, sequential variations of the operation of the sustain and discharge circuit will be described. Here, the variations have six modes, and the variations are generated according to manipulations of switches S1 through S6. The LC resonance is not a continuous oscillation, and it is generated when switches S5 and S6 are turned on. Namely, the LC resonance represents variations of the voltage and the current caused by the combination of inductor L with panel capacitor Cp.

The voltages supplied by first and second power sources V1 and V2 are defined to be V1 and V2, respectively.

(1) Mode 1 (M1)

Referring to FIG. 3A and an interval M1 of FIG. 4, the operation of mode 1 will now be described.

In mode 1, switches S2 and S3 are turned on, and a current path is formed in order of first power source V1, switch S3, panel capacitor Cp, switch S2, and second power source V2, and hence, X and Y electrode voltages Vx and Vy at panel capacitor Cp are maintained at V2 and V1, respectively.

(2) Mode 2 (M2)

Referring to FIG. 3B and an interval M2 of FIG. 4, the operation of mode 2 will now be described.

In mode 2, switch S3 is turned off and switch S6 is turned on while switch S2 is turned on. Current IL at inductor L is increased because of the LC resonance formed from the current path in order of the Y electrode of the panel capacitor, switch S6, diode D1, and inductor L, and Y electrode voltage Vy at panel capacitor Cp is decreased to V2. That is, the energy charged to panel capacitor Cp is stored in inductor L, and since switch S2 is turned on, X electrode voltage Vx at panel capacitor Cp is maintained to be V2.

(3) Mode 3 (M3)

Referring to FIG. 3C and an interval M3 of FIG. 4, the operation of mode 3 will now be described.

Switch S2 is turned off and switch S4 is turned on when current IL flowing to inductor L reaches a maximum value. X electrode voltage Vx is then increased to V1 because of current IL flowing to inductor L. That is, the energy stored in inductor L in mode 2 is used to increase X electrode voltage Vx, and since switch S4 is turned on, Y electrode voltage Vy at panel capacitor Cp is maintained to be V2.

(4) Mode 4 (M4)

Referring to FIG. 3D and an interval M4 of FIG. 4, the operation of mode 4 will now be described.

Switch S1 is turned on, and switch S6 is turned off when current IL flowing to inductor L reaches OA. Since switches S1 and S4 are turned on, the X and Y electrode voltages are continuously maintained to be V1 and V2.

(5) Mode 5 (M5)

Referring to FIG. 3E and an interval M5 of FIG. 4, the operation of mode 5 will now be described.

In mode 5 (M5), switch S1 is turned off and switch S5 is turned on while switch S4 is turned on. An LC resonance is then formed according to a current path in order of the X electrode of panel capacitor Cp, inductor L, diode D2, and switch S5. Current IL flowing to inductor L is increased and X electrode voltage Vx at panel capacitor Cp is reduced to V2 because of the LC resonance. That is, the energy charged to panel capacitor Cp is stored in inductor L, and since switch S4 is turned on, Y electrode voltage Vy is maintained to be V2.

(6) Mode 6 (M6)

Referring to FIG. 3F and an interval M6 of FIG. 4, the operation of mode 6 will now be described.

When current IL flowing to inductor L becomes maximum, switch S2 is turned on and switch S4 is turned off. Y electrode voltage Vy at panel capacitor Cp is then increased to V1 because of current IL flowing to inductor L, and current IL is decreased to OA. That is, Y electrode voltage Vy at panel capacitor Cp is increased using the energy stored in inductor L, and since switch S2 is turned on, X electrode voltage Vx is maintained to be V2.

According to the first embodiment, rising interval M3 of X electrode voltage Vx and falling interval M2 of the Y electrode voltage, and falling interval M5 of X electrode voltage Vx and rising interval M6 of the Y electrode voltage, respectively become different.

In the first embodiment, a falling interval of one electrode voltage is set to be faster than a rising interval of another electrode voltage, and further, a rising interval of one electrode voltage may be set to be faster than a falling interval of another electrode voltage. A corresponding embodiment will be described with reference to FIGS. 5A through 5F and 6.

Figure 5A:
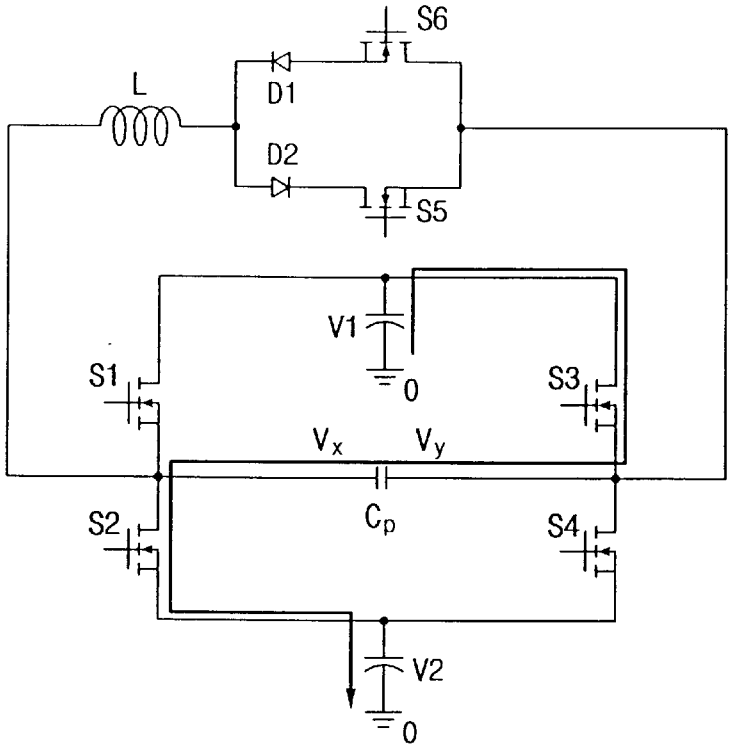
FIGS. 5A through 5F show current paths of respective modes according to a second embodiment of the present invention.
Figure 5B:
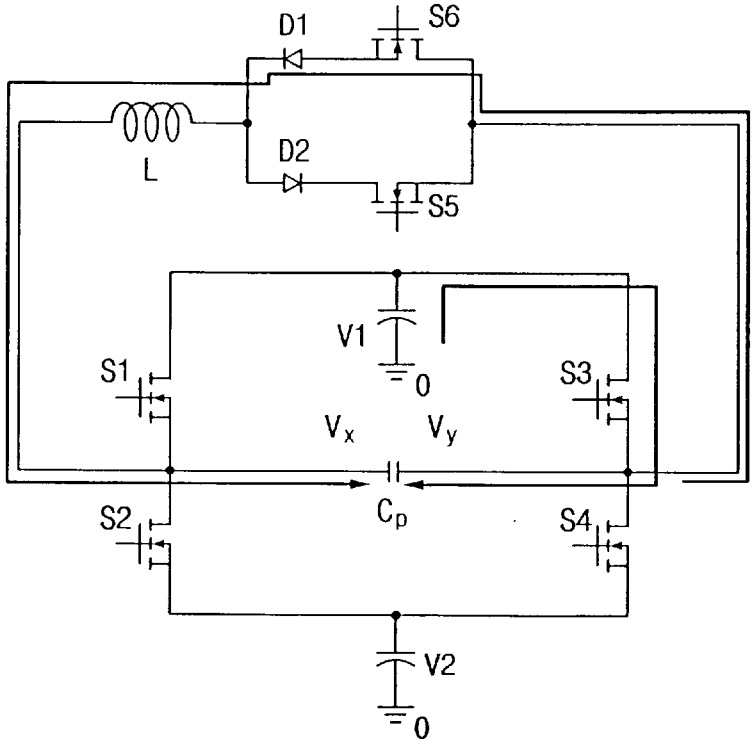
Figure 5C:
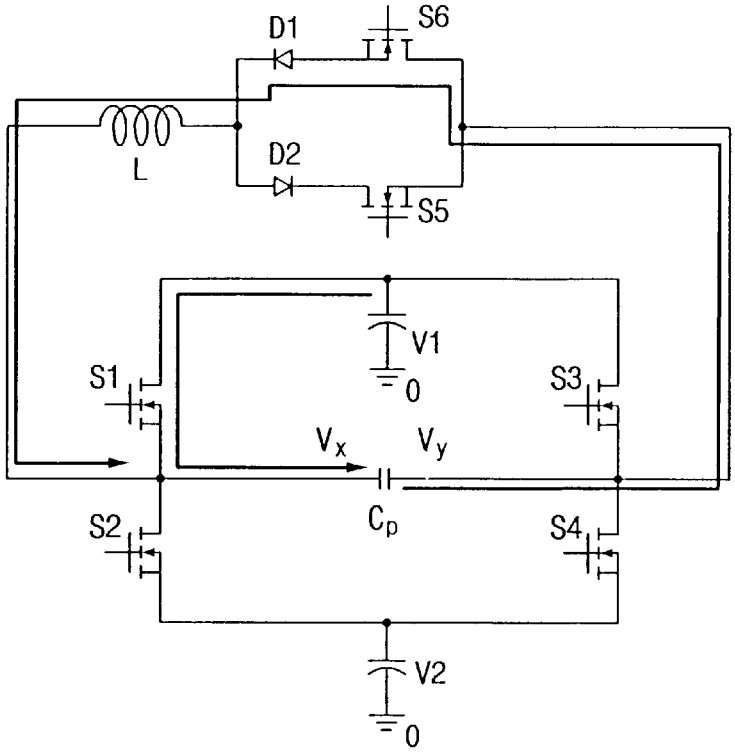
Figure 5D:
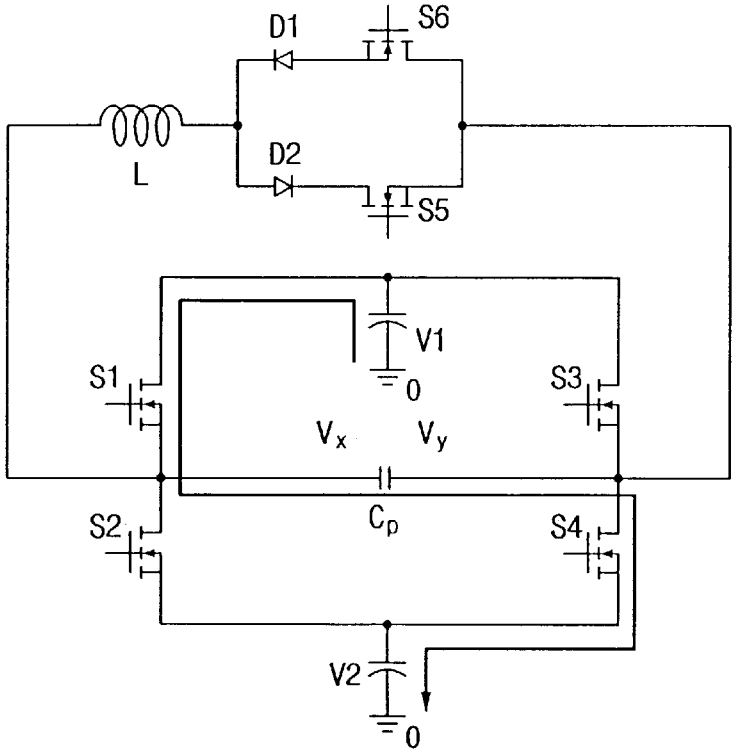
Figure 5E:
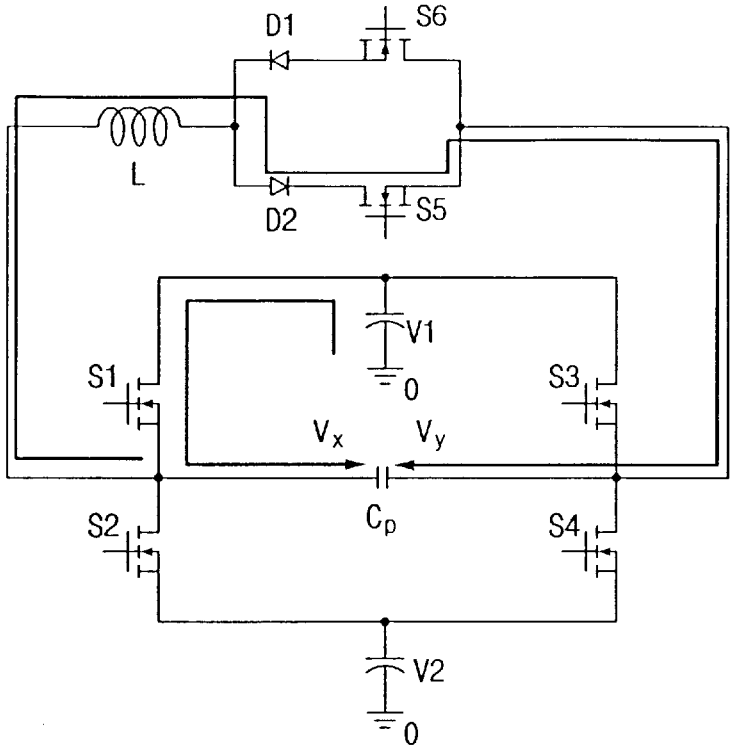
Figure 5F:
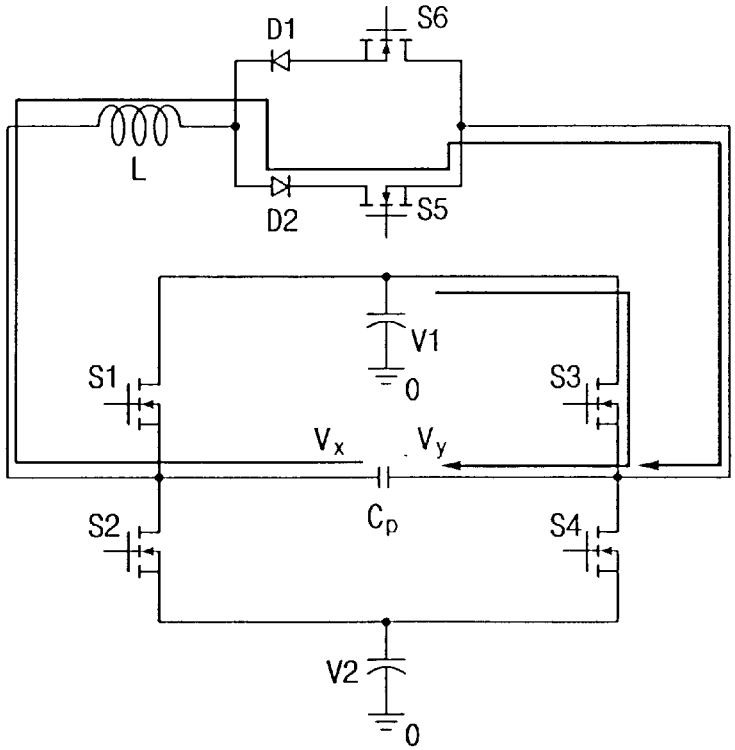
Figure 6:
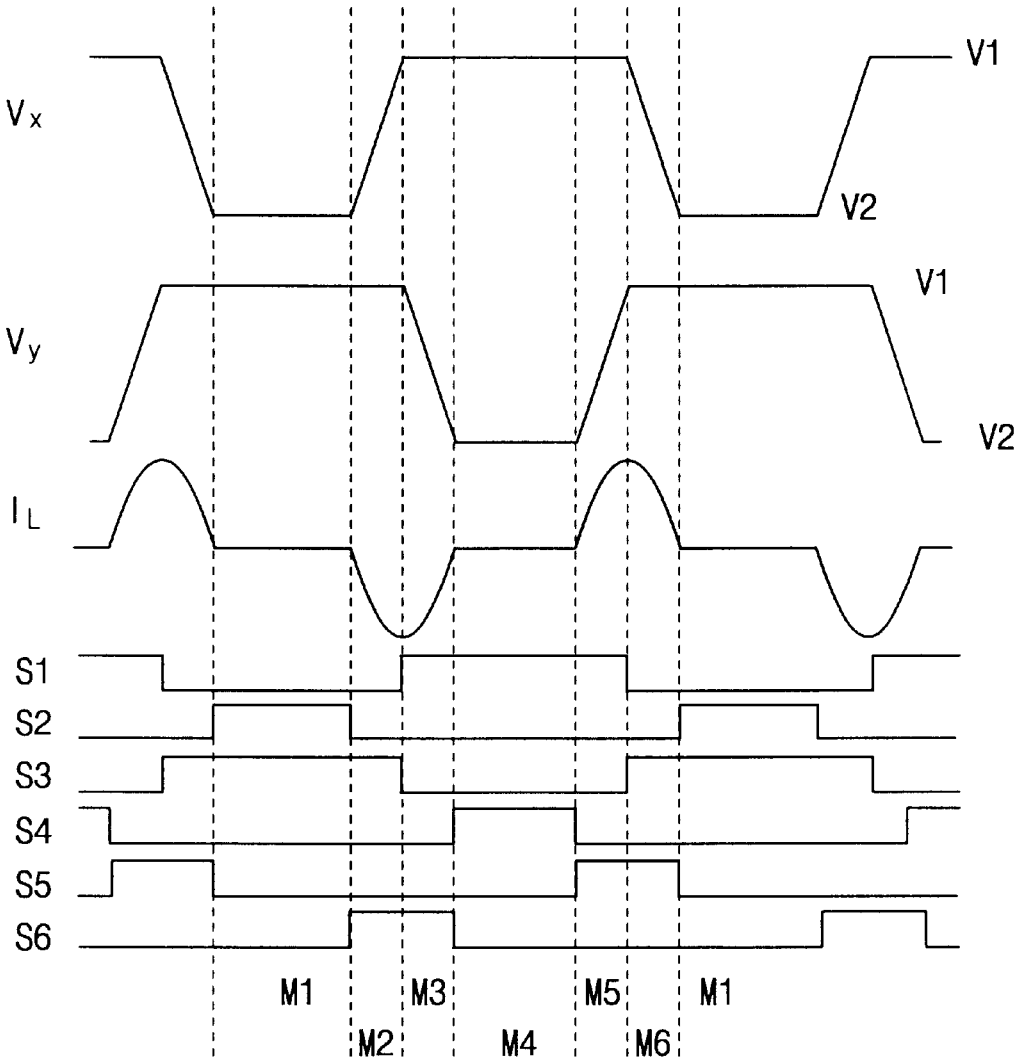
FIG. 6 shows an operational timing diagram of the PDP according to the second embodiment of the present invention.

FIGS. 5A through 5F show current paths of respective modes according to a second embodiment of the present invention, and FIG. 6 shows an operational timing diagram of the PDP according to the second embodiment of the present invention.

As shown, the operation of the PDP according to the second embodiment of the present invention is matched with that of the first embodiment of the present invention, except for the operation of modes 2, 3, 5, and 6.

In detail, as shown in FIGS. 5B and 6, switches S3 and S6 are turned on in mode 2 (M2) to maintain Y electrode voltage Vy to be V1, and increase X electrode voltage Vx to V1 through the LC resonance. As shown in FIGS. 5C and 6, switches S1 and S6 in mode 3 (M3) are turned on to maintain the X electrode voltage to be V1 and reduce the Y electrode voltage to V2. That is, the rising interval of the X electrode voltage is set to be faster than the falling interval of Y electrode voltage Vy. As shown in FIGS. 5D and 6, switches S1 and S4 are turned on to maintain X and Y electrode voltages Vx and Vy to be V1 and V2, respectively.

As shown in FIGS. 5E and 6, switches S1 and S5 are turned on in mode 5 (M5) to maintain X electrode voltage Vx to be V1 and increase Y electrode voltage Vy to V1 through the LC resonance. As shown in FIGS. 5F and 6, switches S3 and S5 are turned on in mode 6 (M6) to maintain Y electrode voltage Vy to be V1 and reduce X electrode voltage Vx to V2. After this, switches S2 and S3 are turned on in the like manner of mode 1 (Ml) to maintain X and Y electrode voltages Vx and Vy to be V2 and V1, respectively.

In the first and the second embodiments of the present invention, the power may be recovered without using an external power recovery capacitor.

Figure 7:
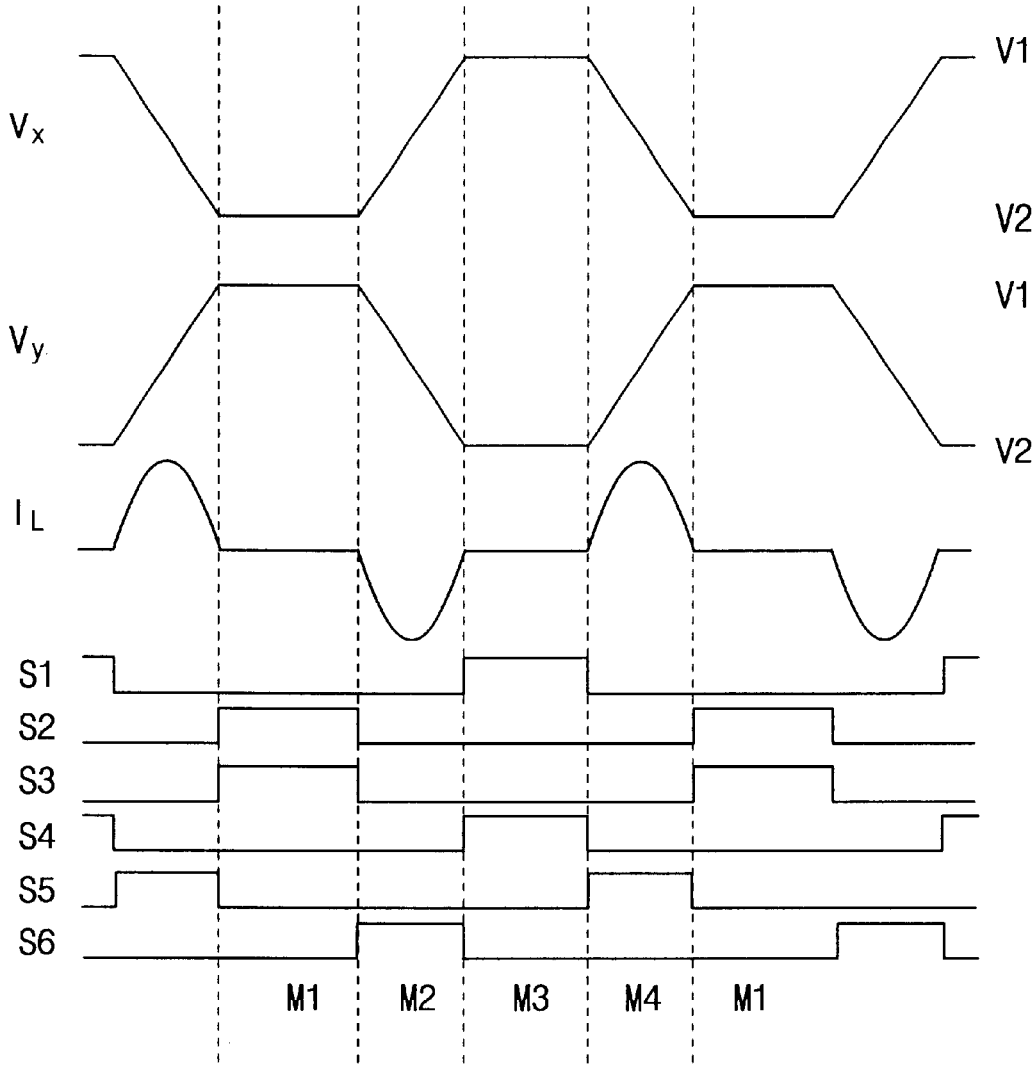
FIG. 7 shows a conventional operational timing diagram of the PDP.

In the first and the second embodiments, the rising interval of one electrode voltage and the falling interval of another electrode voltage are differently set. Further, it is possible to identically set the falling interval and the rising interval in the like manner of the method disclosed by Ooba. Namely, as shown in mode 2 (M2) of FIG. 7, X and Y electrode voltages Vx and Vy may concurrently fall and rise respectively by concurrently turning switches S2 and S3 off and turning switch S6 on.

The falling interval and the rising interval of the both electrode voltages of panel capacitor Cp may be set to be identical, but in this case, it is impossible to use a PDP that requires different rising and falling intervals. Also, the PDP's power consumption is reduced and corresponding luminance is improved when the rising and falling intervals are differentiated in the like manners of the first and the second embodiments, differing from the case of identical rising and falling intervals of both electrode voltages. That is, the efficiency of the PDP is increased.

In the first and the second embodiments, a single inductor is used to change X and Y electrode voltages Vx and Vy. In addition, a first inductor for increasing X electrode voltage Vx and decreasing Y electrode voltage Vy, and a second inductor for decreasing X electrode voltage Vx and increasing Y electrode voltage Vy may be used, which will be described referring to FIG. 8.

Figure 8:
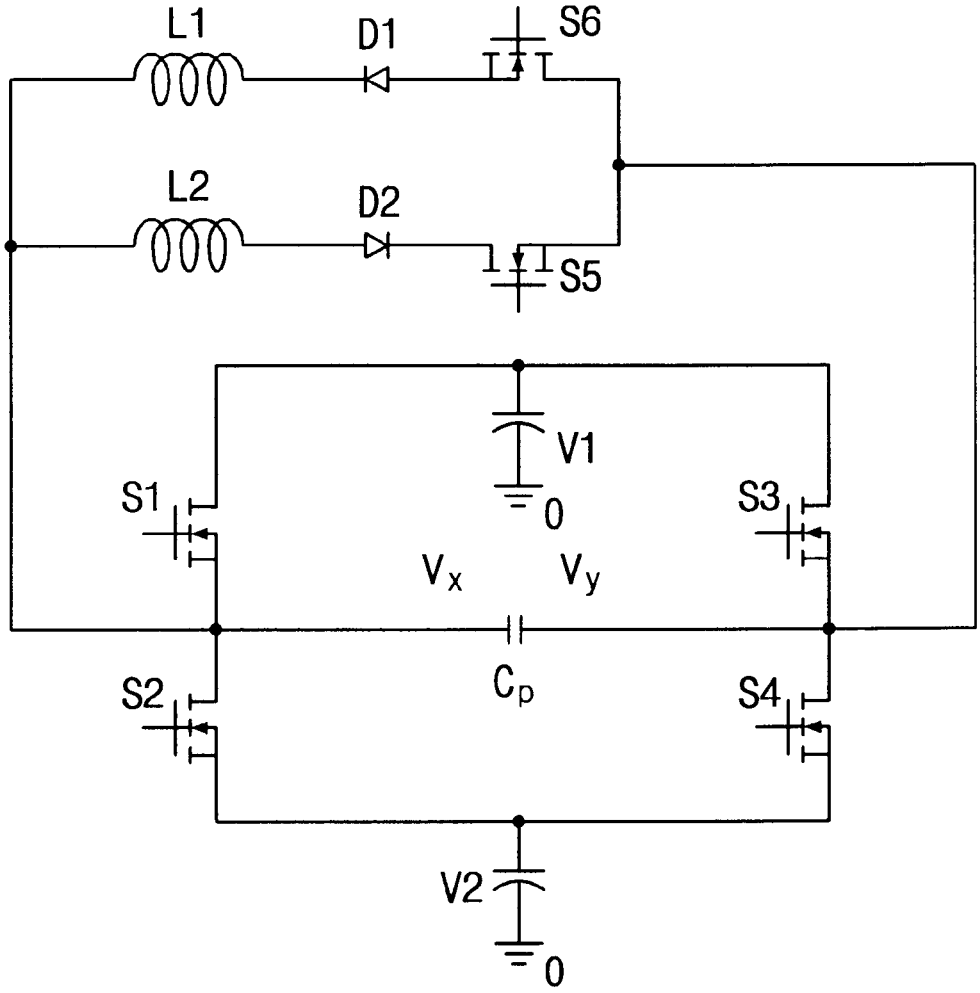
FIG. 8 shows a sustain and discharge circuit according to a third embodiment of the present invention.

FIG. 8 shows a sustain and discharge circuit according to a third embodiment of the present invention.

As shown, the sustain and discharge circuit according to the third embodiment has a configuration matched with that of the first embodiment except that the sustain and discharge circuit according to the third embodiment includes two inductors L1 and L2.

In detail, in the third embodiment, ends of inductors L1 and L2 are coupled to ends of switches S6 and S5 respectively, and other ends of inductors L1 and L2 are coupled in parallel to a point where switches S1 and S2 meet. The sustain and discharge circuit according to the third embodiment may further include diodes D1 and D2. Diode D1 is coupled between inductor L1 and switch S6, and diode D2 is coupled between inductor L2 and switch S5. Further, diode D1 may be coupled between inductor L1 and the point where switches S1 and S2 meet, and diode D2 may be coupled between inductor L2 and the point where switches S1 and S2 meet.

The driving timing method according to the first and the second embodiments may be applied to the PDP driving method including a sustain and discharge circuit according to the third embodiment. In this instance, excluding that current flowing inductor L1 in modes 2 and 3 (M2 and M3) is different from current flowing inductor L2 in modes 5 and 6 (M5 and M6), the operation of the third embodiment is identical with the operation of the first or the second embodiment.

For example, referring to FIG. 4, respective Y electrode voltages Vy fall and X electrode voltages Vx rise according to the current path in order of panel capacitor Cp, switch S6, diode D1, and inductor L1 in modes 2 and 3 (M2 and M3). Respective X electrode voltages Vx fall and Y electrode voltages Vy rise according to the current path in order of panel capacitor Cp, inductor L2, diode D2, and switch S5 in modes 5 and 6 (M5 and M6).

According to the present invention, the power may be recovered without using an external capacitor, and the rising and falling intervals of the X and Y electrode voltages become different, and accordingly, this method may be applied to a PDP that requires different rising and falling intervals. The power consumption is also reduced and the luminance is improved compared to a case in which the rising and falling intervals are matched.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A device for driving a plasma display panel having a plurality of scan electrodes and sustain electrodes alternately arranged in pairs, wherein a panel capacitor is formed between a scan electrode and a sustain electrode pair, the device comprising:

a first sustain and discharge unit coupled to a first electrode of the panel capacitor, and coupled between a first power source for supplying a first voltage and a second power source for supplying a second voltage, for operating so that the first electrode is maintained to be one of the first and the second voltages;

a second sustain and discharge unit coupled to a second electrode of the panel capacitor, and coupled between the first power source and the second power source so that the second electrode is maintained to be one of the first and the second voltages; and a charge and discharge unit including at least one inductor coupled to the panel capacitor, for converting a voltage at the second electrode into the second voltage to store energy in the inductor, using the energy stored in the inductor to convert the voltage at the first electrode into the first voltage, converting the voltage at the first electrode into the second voltage to store energy in the inductor, and using the energy stored in the inductor to convert the voltage at the second electrode into the first voltage.

2. The device of claim 1, wherein the voltage at the first electrode is converted into the first voltage after the voltage at the second electrode is converted into the second voltage.

3. The device of claim 1, wherein the voltage at the second electrode is converted into the first voltage after the voltage at the first electrode is converted into the second voltage.

4. The device of claim 1, wherein the charge and discharge unit uses an identical inductor to convert the voltage at the second electrode into the second voltage and store energy, and convert the voltage at the first electrode into the second voltage and store energy.

5. The device of claim 1, wherein the charge and discharge unit uses different inductors to convert the voltage at the second electrode into the second voltage and store energy, and convert the voltage at the first electrode into the second voltage and store energy.

6. The device of claim 1, wherein the charge and discharge unit further comprises:

a first switch for converting the voltage at the second electrode into the second voltage and converting the voltage at the first electrode into the first voltage; and a second switch for converting the voltage at the first electrode into the second voltage and converting the voltage at the second electrode into the first voltage.

7. The device of claim 1, wherein the charge and discharge unit converts the voltages at the second and the first electrodes into the respective second and the first voltages sequentially to maintain the voltages at the first and the second electrodes to be the first and the second voltages, and converts the voltages at the first and the second electrodes into the respective second and the first voltages sequentially to maintain the voltages at the first and the second electrodes to be the second and the first voltages.

8. A method for driving a plasma display panel having a panel capacitor formed between each of a plurality of scan electrodes and a plurality of sustain electrodes alternately arranged with the scan electrodes in pairs, at least one inductor coupled to the panel capacitor, and a driver coupled between a first power source for supplying a first voltage and a second power source for supplying a second voltage, the method comprising:

(a) maintaining the panel capacitor voltages at a first electrode and a second electrode to be the second voltage and the first voltage, respectively;

(b) converting the voltage at the second electrode into the second voltage and storing energy in the inductor;

(c) using the energy stored in the inductor to convert the voltage at the first electrode into the first voltage;

(d) maintaining the voltages at the first and the second electrodes to be the first and the second voltages, respectively;

(e) converting the voltage at the first electrode into the second voltage and storing energy in the inductor; and (f) using the energy stored in the inductor to convert the voltage at the second electrode into the first voltage.

9. The method of claim 8, the voltage at the first electrode is converted into the first voltage in (c) after the voltage at the second electrode is converted into the second voltage in (b).

10. The method of claim 8, the voltage at the second electrode is converted into the first voltage in (f) after the voltage at the first electrode is converted into the second voltage in (e).

11. The method of claim 8, wherein an identical inductor is used in (a), (b), (d), and (e) to convert the voltages at the first and the second electrodes.

12. The method of claim 8, wherein the inductor used in (a) and (b) and the inductor used in (d) and (e) are different.

13. A method for driving a plasma display panel having a panel capacitor formed between each of a plurality of first and second electrodes alternately arranged in pairs, a first switch and a second switch coupled in series between a first power source for supplying a first voltage and a second power source for supplying a second voltage, wherein a point where the first and the second switches meet is coupled to the first electrode of the panel capacitor, a third switch and a fourth switch coupled in series between the first power source and the second power source, wherein a point where the third and the fourth switches meet is coupled to the second electrode of the panel capacitor, at least one inductor having one end coupled to the point where the first and the second switches meet, and a fifth switch and a sixth switch respectively coupled to the inductor, wherein a point where the fifth and sixth switches meet is coupled to the point where the third and fourth switches meet, the method comprising:

(a) turning on the second and the third switches to maintain voltages at the first and the second electrodes to be the second and the first voltages;

(b) turning off the third switch and turning on the sixth switch to convert the voltage at the second electrode into the second voltage;

(c) turning off the second switch and turning on the fourth switch to convert the voltage at the first electrode into the first voltage and maintain the voltage at the second electrode to be the second voltage;

(d) turning off the sixth switch and turning on the first switch to maintain the voltages at the first and the second electrodes to be the first and the second voltages;

(e) turning off the first switch and turning on the fifth switch to convert the voltage at the first electrode into the second voltage; and (f) turning off the fourth switch and turning on the second switch to convert the voltage at the second electrode into the first voltage.

14. The method of claim 13, wherein the second switch is turned off and the fourth switch is turned on in (c) after the voltage at the second electrode is converted into the second voltage in (b).

15. The method of claim 13, wherein the fourth switch is turned off and the second switch is turned on in (f) after the voltage at the first electrode is converted into the second voltage in (e).

16. The method of claim 13, wherein the voltage at the second electrode is converted into the second voltage to store energy in the inductor in (b), the energy stored in the inductor is used to convert the voltage at the first electrode into the first voltage in (c), the voltage at the first electrode is converted into the second voltage to store energy in the inductor in (e), and the energy stored in the inductor is used to convert the voltage at the second electrode into the first voltage in (f).

17. The method of claim 16, wherein an identical inductor is used in (a), (b), (d), and (e) to convert the voltages at the first and the second electrodes.

18. The method of claim 16, wherein the inductor used in (a) and (b) and the inductor used in (d) and (e) are different.

19. A method for power recovery for a plasma display panel having a plurality of scan electrodes and sustain electrodes alternately arranged in pairs, comprising:

forming a panel capacitor between each scan electrode and sustain electrode pair;

coupling a first sustain and discharge unit to a first electrode of the panel capacitor and between a first power source for supplying a first voltage and a second power source for supplying a second voltage such that the first electrode is maintained to be one of the first voltage and the second voltage;

coupling a second sustain and discharge unit to a second electrode of the panel capacitor and between the first power source and the second power source such that the second electrode is maintained to be one of the first voltage and the second voltage; and providing a charge and discharge unit having at least one inductor coupled to the panel capacitor for converting a voltage at the second electrode into the second voltage to store energy in the inductor, using the energy stored in the inductor to convert the voltage at the first electrode into the first voltage, converting the voltage at the first electrode into the second voltage to store energy in the inductor, and using the energy stored in the inductor to convert the voltage at the second electrode into the first voltage.

20. The method of claim 19, further comprising converting the voltage at the first electrode into the first voltage after converting the voltage at the second electrode into the second voltage.

21. The method of claim 19, further comprising converting the voltage at the second electrode into the first voltage after converting the voltage at the first electrode into the second voltage.

22. The method of claim 19, further comprising the charge and discharge unit using an identical inductor to convert the voltage at the second electrode into the second voltage and store energy and to convert the voltage at the first electrode into the second voltage and store energy.

23. The method of claim 19, further comprising the charge and discharge unit using different inductors to convert the voltage at the second electrode into the second voltage and store energy and to convert the voltage at the first electrode into the second voltage and store energy.

24. The method of claim 19, further comprising providing the charge and discharge unit with a first switch for converting the voltage at the second electrode into the second voltage and converting the voltage at the first electrode into the first voltage, and a second switch for converting the voltage at the first electrode into the second voltage and converting the voltage at the second electrode into the first voltage.

25. The method of claim 19, further comprising the charge and discharge unit converting the voltages at the second and the first electrodes into the respective second and the first voltages sequentially to maintain the voltages at the first and the second electrodes to be the first and the second voltages, and converting the voltages at the first and the second electrodes into the respective second and the first voltages sequentially to maintain the voltages at the first and the second electrodes to be the second and the first voltages.

* * * * *